US005918561A

United States Patent [19]

Berean

[11] Patent Number: 5,918,561

[45] Date of Patent: Jul. 6, 1999

[54] LIFT CREATING SAIL AND SAIL SYSTEM

[76] Inventor: George S. Berean, 2660 E Waiomao Rd., Hnl, Hi. 96816

[21] Appl. No.: 08/982,615

[22] Filed: Dec. 2, 1997

[51] Int. Cl.[6] ..... B63H 9/04

[52] U.S. Cl. ..... 114/102.16; 114/102.18

[58] Field of Search ..... 114/39.1, 61, 89, 114/90, 97, 98, 102, 103, 109, 111, 39.11, 39.21, 102.1, 102.16, 102.18, 102.19

[56] References Cited

U.S. PATENT DOCUMENTS

| | | | |
|---|---|---|---|
| 587,046 | 7/1897 | Smith | 114/103 |
| 758,171 | 4/1904 | Collins | 114/103 |
| 4,005,669 | 2/1977 | Klemm | 114/91 |
| 4,584,957 | 4/1986 | Belvedere | 114/39 |
| 4,653,417 | 3/1987 | White | 114/91 |
| 4,671,201 | 6/1987 | Yokoyama | 114/102 |
| 4,917,036 | 4/1990 | Berg | 114/91 |
| 5,509,368 | 4/1996 | Wald | 114/39.1 |

FOREIGN PATENT DOCUMENTS

| | | | |
|---|---|---|---|
| WO 92/16407 | 10/1992 | WIPO | 114/61 |

*Primary Examiner*—Ed L. Swinehart
*Attorney, Agent, or Firm*—Clifford Kraft

[57] ABSTRACT

An improved lift creating sail and sail system where a substantially rectangular mainsail made up of a plurality of panels forms an aerodynamically efficient airfoil that is supported at approximately its center on a pivot so that it has three degrees of freedom. The mainsail can be tilted athartships, rotated along a yaw axis, and tilted fore and aft to create lift and minimum drag. An optional jib sail that tracks the motion of the mainsail also produces lift. The mainsail and jib sail can be trimmed and positioned along three degrees of freedom to obtain maximum lift and minimum drag as well as a stable system. The effect of this sail system is to increase the speed of the boat by 15–25%.

11 Claims, 7 Drawing Sheets

LIFT CREATING SAIL AND SAIL SYSTEM

FIELD OF THE INVENTION

This invention relates generally to the field of sails and sail boats and more particularly to a mainsail that can create lift and a sail system of a mainsail and a jib sail that together create lift and increase the speed of a sailboat by 15–25%.

DESCRIPTION OF RELATED ART

A sailboat is propelled by wind impinging on a sail to create thrust (a forward force vector). A typical sail however, also creates drag (an aftward force vector) tending to cancel thrust. In addition, the boat's hull creates considerable drag as it passes through the water. The magnitude of the total drag force is proportional to coat's velocity and is related to the amount of the hull under water, the exact shape of the hull, the size and shape of the sail, and other factors. If a sail system can create lift (an upward force vector) as well as thrust and drag, the hull is pulled more out of the water (called a reduction in heeling). This effect can considerably reduce drag caused by the hull. Since hull drag is the major component of drag, the speed of the boat can be substantially increased. Also, if airflow over the sail can be optimized, sail drag is decreased as well resulting in further increases in speed.

Prior art systems for achieving lift on a sailboat have operated off of a single mainsail attached to a mast that could be tilted such that the top of the sail moved windward of the centerline of the boat. The idea was to incline a conventional sail athwartship so that the top of the sail moves into the wind producing lift as well as thrust. However, simply tilting the sail causes an undesirable side effect called "lee helm." This is a tendency for the boat to try to turn away from the wind requiring the continuous use of rudder to maintain a heading. This use of rudder causes extra drag slowing the boat. "Lee helm" is actually caused by a resultant force moment created by the center of pressure in the sail being windward of the centerline of the boat. In order to counter "lee helm" some prior art systems tilt the sail aft as well as athwartship to achieve a canceling moment.

Prior art systems all attach the base of the mast to either a flexible joint on the centerline or to a straight or curved track running athartship. This has the disadvantage of not being able to position the sail at an optimum angle with respect to the wind for maximum lift and minimum drag. Prior art systems also use conventional triangular sails which are also not optimum for producing maximum lift. Finally, no attempt has been made in prior art systems to make use of a jib sail that works in harmony with the mainsail and moves optimally with the mainsail to also produce lift.

What is badly needed is a lift producing sail and sail system that uses an optimally shaped sail that is not attached to the mast at its foot. This sail should be attached to the boat in a way that it can be tilted along three axes and thus create optimum lift and thrust for any heading with respect to the wind. In addition, an optional jib sail should work in harmony with the mainsail leading to additional lift. Finally, there should be a way to control the size or amount of sail exposed to the wind so that an optimum sail can be fashioned for any wind speed.

SUMMARY OF THE INVENTION

The present invention relates to an improved lift creating sail and sail system. It may contain a mainsail and a jib sail.

Both sails can be tilted to produce lift. The mainsail is an aerodynamically efficient airfoil that can be made from a set of panels. The mainsail is normally mounted on a pivot that can be located near the its center. The pivot is normally attached to an A-frame in such a way that it can move about three degrees of freedom. This way the mainsail can be tilted athartships (port and starboard); it can be rotated along the yaw axis; and it can be tilted fore and aft. The mainsail can be of generally rectangular shape, or any other convenient shape, and can be furled by either rolling it up or gathering it in. The various axes of tilt and rotation are totally general whereby the sail can be tilted or yawed to any angle or orientation with respect to the boat and the wind. In this manner, the generally rectangular sail can be used so that its length is generally up and down or it can be tilted so that its length is substantially horizontal as a square sail. It can, at the same time, be yawed to any angle and tilted athartships to any angle. The mainsail can be mounted so that its weight rests on the pivot and A-frame from its center. There is generally no mast and no weight supported by the base of the mainsail.

The system can also have a jib sail that also tilts into the wind to generate additional lift and to compensate for any lee helm effect. This jib can track the athartship tilt of the mainsail, or it can be positioned at a different angle for optimum trim and efficiency. The total flexibility of tilt angles for both the mainsail and the job, coupled with the use of a lift creating jib and the ability to furl, yields a sail system that creates optimum lift (leading to minimum total drag on the boat) for any wind direction, velocity, or condition.

DESCRIPTION OF THE PREFERRED EMBODIMENT

Figure 1:
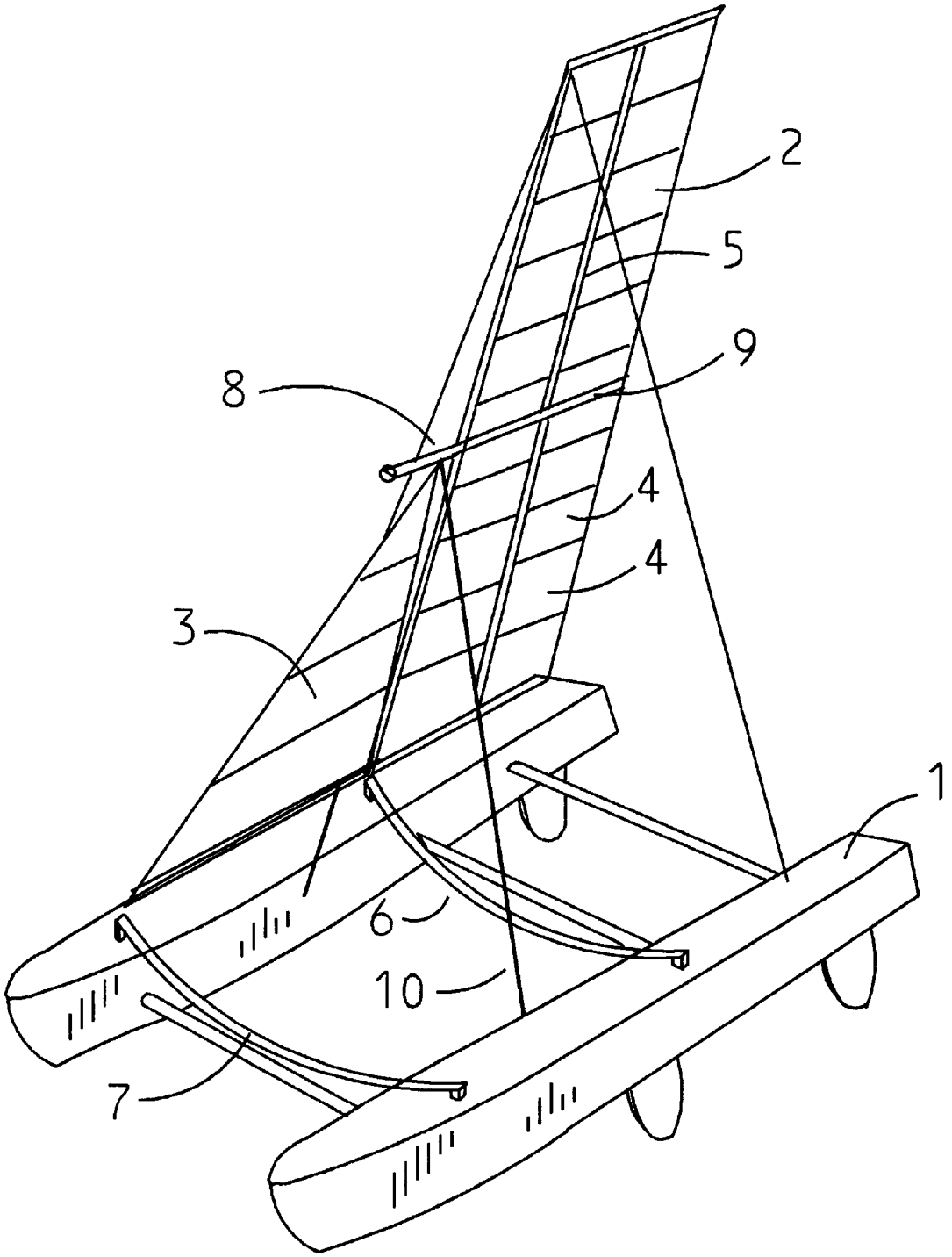
FIG. 1 shows a perspective view of a type of sailboat equipped with an embodiment of the present invention.

FIG. 1 shows an embodiment of the present invention in perspective view on a type of sailboat with two hulls. The invention is equally suited for use on a monohull boat or any other combination of hulls. In FIG. 1, each of the hulls 1 is elongated with a major axis defining a fore and aft direction along the boat. The mainsail 2 in this embodiment is substantially rectangular; however, the mainsail can have any other convenient shape without deviating from the scope of the present invention. The jib sail 3 is substantially triangular in this embodiment, and can be mounted forward of the mainsail 2. The jib sail can have any other convenient shape without deviating from the scope of the present invention.

The mainsail 2 shown in FIG. 1 can be made of several panels 4 of sail material, or it can be a continuous sail. The panels 4 are held together using spars 5 or trusses, or any other construction means to form a semi-rigid frame.

The mainsail 2 is normally mounted at a pivot 8 that allows it three degrees of freedom. This means that the mainsail 2 can be tilted athartships and fore and aft, and it can be yawed to any angle with respect to the centerline of the boat. A truss or cross spar 9 can be located at the center of the mainsail 2, and one end of this truss 9 is normally attached to the pivot point 8. The pivot 8 is firmly attached to an A-frame 10 that is normally rigidly attached to the hull(s) 1. The entire weight of the mainsail 2 can rest on this pivot 8. The base of the mainsail is not normally attached to the hull. The A-frame 10 thus supports the mainsail 2.

An optional track or traveler 6 is normally located below the pivot 8 at the level of the top of the hull(s) 1. This track is generally not attached to the base of the mainsail. In fact, the base of the mainsail 2 can move substantially away from this track 6 when the mainsail is tilted fore and aft. The optional track 6 allows the tilt motion or position of the mainsail 2 to be cross coupled to the jib sail 3. The forward foot of the jib sail 3 can be attached to a second track 7 that is also part of the cross coupling of motion from the mainsail to the jib sail. The actual cross coupling of position can be accomplished with lines or any other means that will couple motion from one of the sails to the other. The top or head of the jib sail is normally attached to the pivot point 8. Thus, the fore foot of the jib sail moves in the same direction as the fore foot of the mainsail. The means of coupling the motion of the two sails in this embodiment of the present invention can be through cross-rigged lines between the mainsail track or traveler 6 and fore foot of the jib sail on its track 7.

Figure 2A:
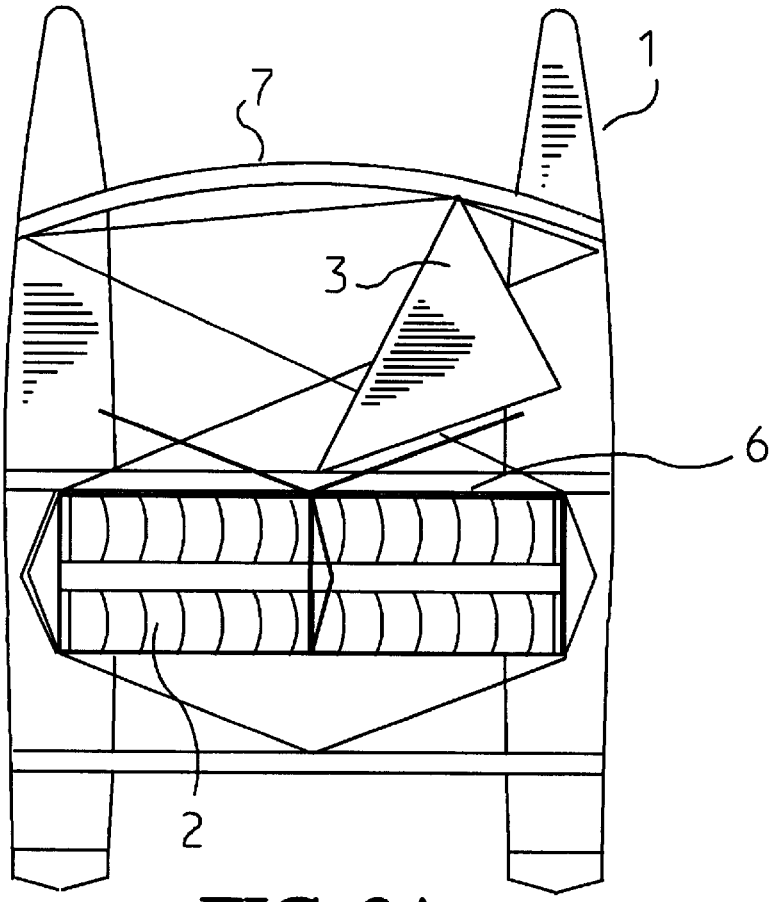
FIG. 2 shows a top view and a front view of at type of sailboat equipped with an embodiment of the present invention.
Figure 2B:
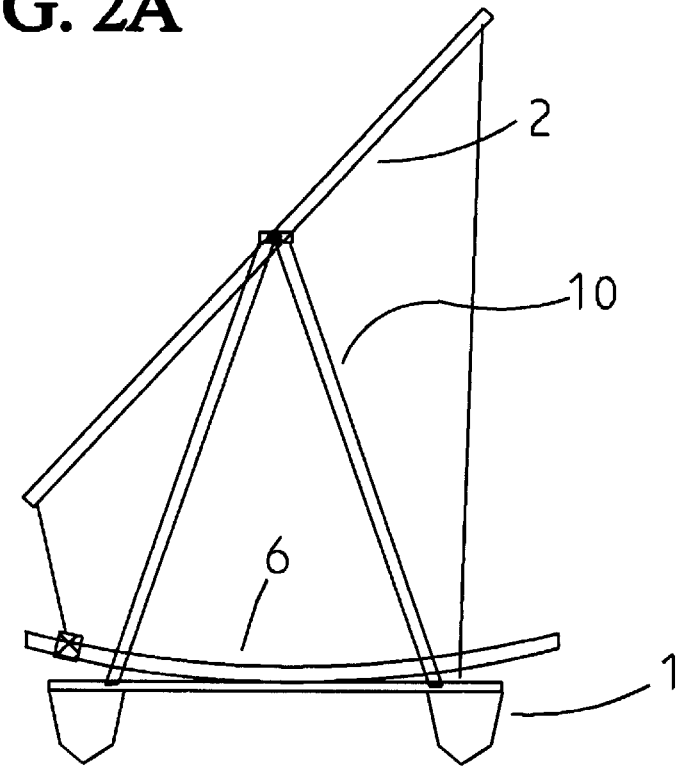

FIG. 2 shows a top view and a front view of the embodiment of the present invention of FIG. 1. In FIG. 2, the hull 1, mainsail 2, jib sail 3 and the jib sail track 7 can be clearly seen. The position of the mainsail track 6 is also shown for clarity. In FIG. 2, the athartship tilt of the mainsail 2 can also be clearly seen.

Figure 3:
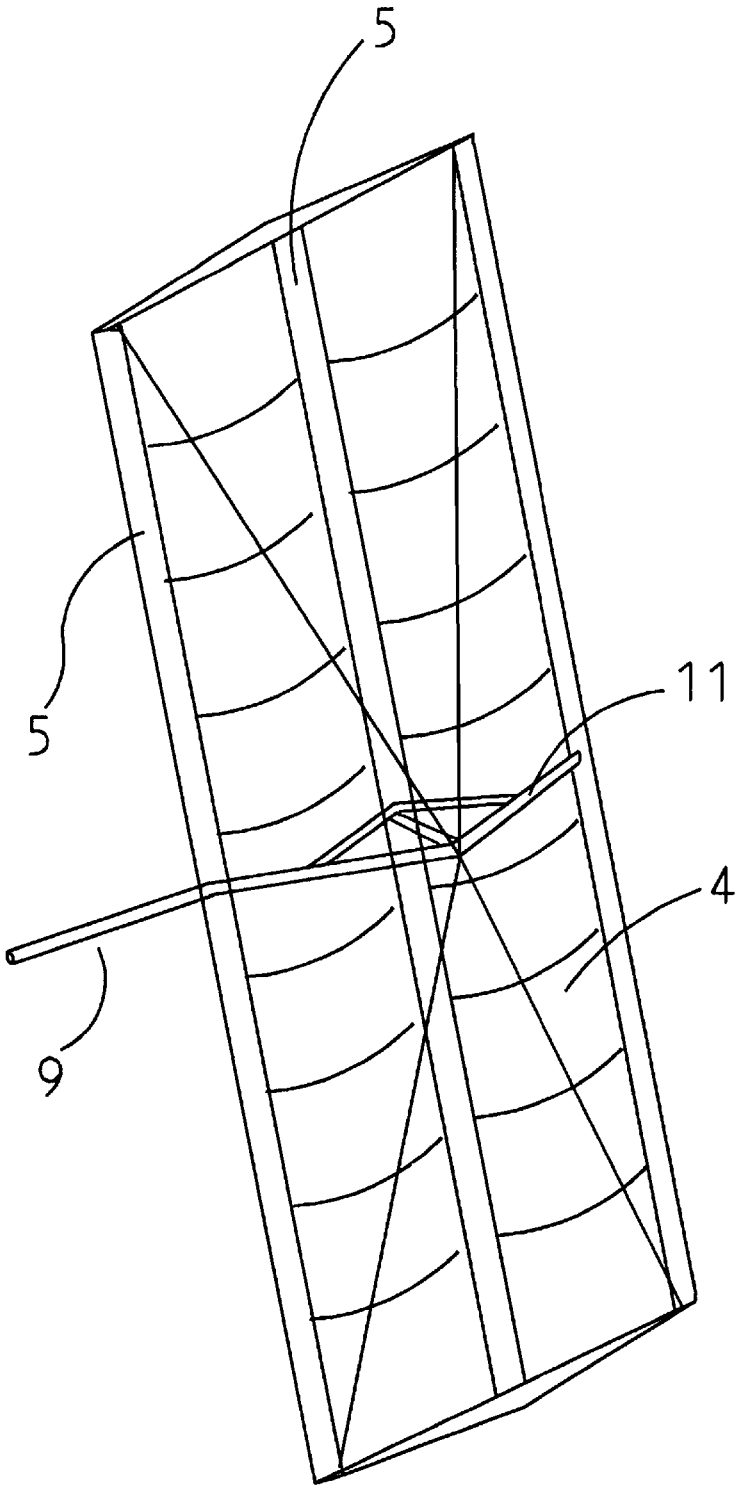
FIG. 3 shows a perspective view of an embodiment of a mainsail.

FIG. 3 shows a slightly different embodiment of the mainsail from that shown in FIG. 1. In this embodiment, the mainsail is made up from a plurality of panels 4 of sail material on a frame made up of longitudinal spars 5. The horizontal truss 9 can be seen attached to a cross truss 11 at the center of the mainsail. Either a truss or a cross spar can be used; however, a truss has been found to be stronger.

Figure 4A:
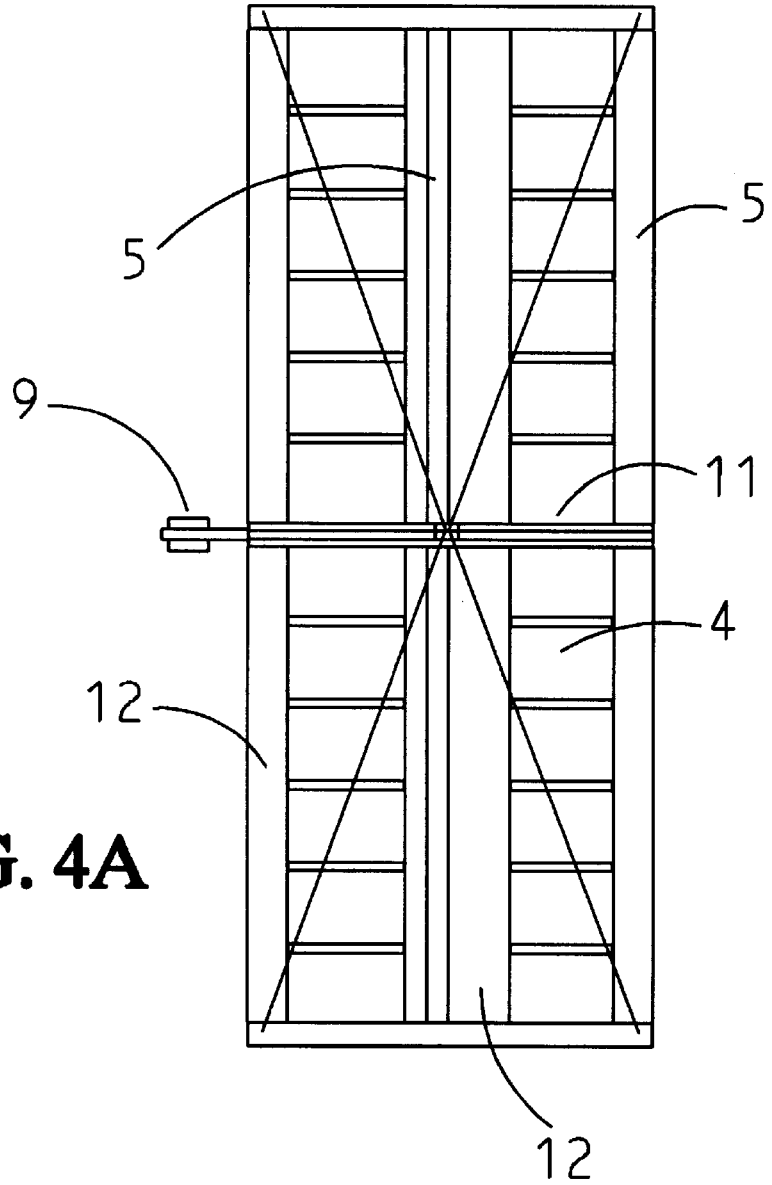
FIG. 4 shows a side view and a top view of an embodiment of a mainsail.
Figure 4B:
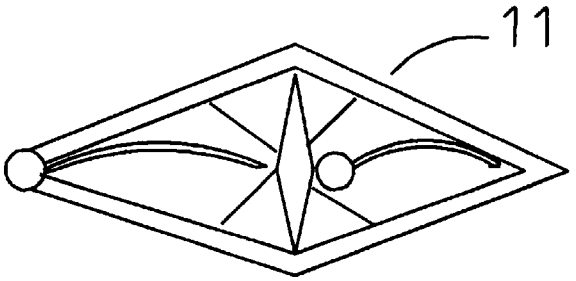

FIG. 4 is a side and top view of the mainsail of FIG. 3. Here the structure of the optional truss 11 can be more clearly seen. Also in FIG. 4, two leading edge foils 12 can be seen. These allow the individual panels of the mainsail to rotate about the longitudinal spar. The sail area can be varied by furling in and out the sail which can be rolled around the longitudinal spar. In an alternate embodiment of the present invention, the sail area can be varied by sliding the sail towards the cross spar. This allows the use of pliable battens rather than reinforced seams.

Figure 5A:
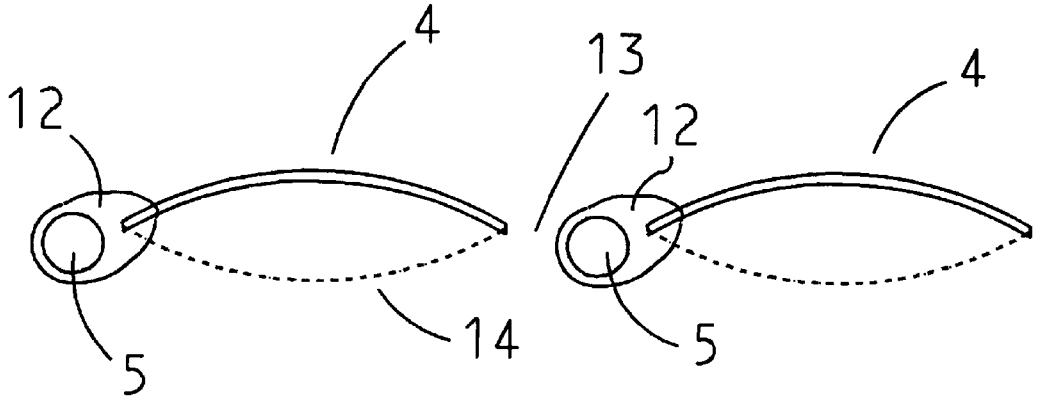
FIG. 5 shows an embodiment of the mainsail panels creating an air slot.
Figure 5B:
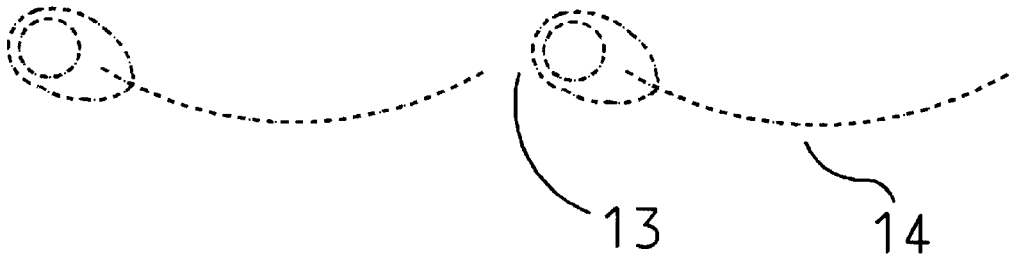

FIG. 5 shows an embodiment of the leading edge foil that would vary the sail area by sliding the sail towards the cross spar. In FIG. 5, the vertical spars 5 are seen with the sail panels attached through leading edge foils 12. The leading edge foils 12 freely rotate about the spars 5 allowing the panel 4 to take various positions with respect to the wind. An alternate position is shown by a broken line 14 in FIG. 5. Between the fore and aft panels of the mainsail is an air slot 13. This optional feature allows a tremendous increase in the efficiency of the mainsail by acting as a boundary layer control device such as might be found on the wing of a high performance aircraft. By keeping the boundary layer of the airflow close to the surface of the panel, drag caused by the sail itself is tremendously reduced.

Figure 6A:
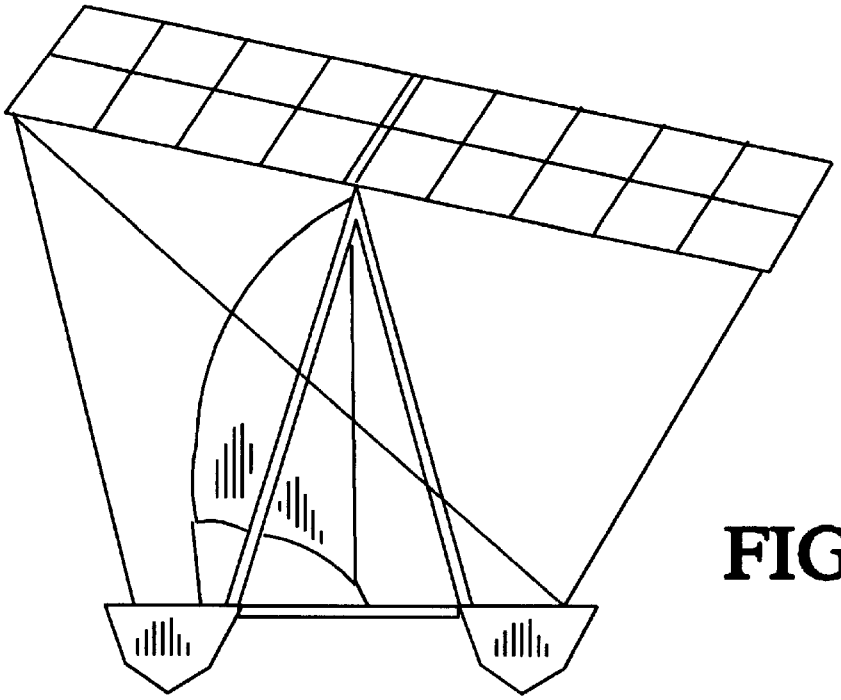
FIG. 6 shows how the present invention is operated in reach or tack (wind athartships or forward).
Figure 6B:
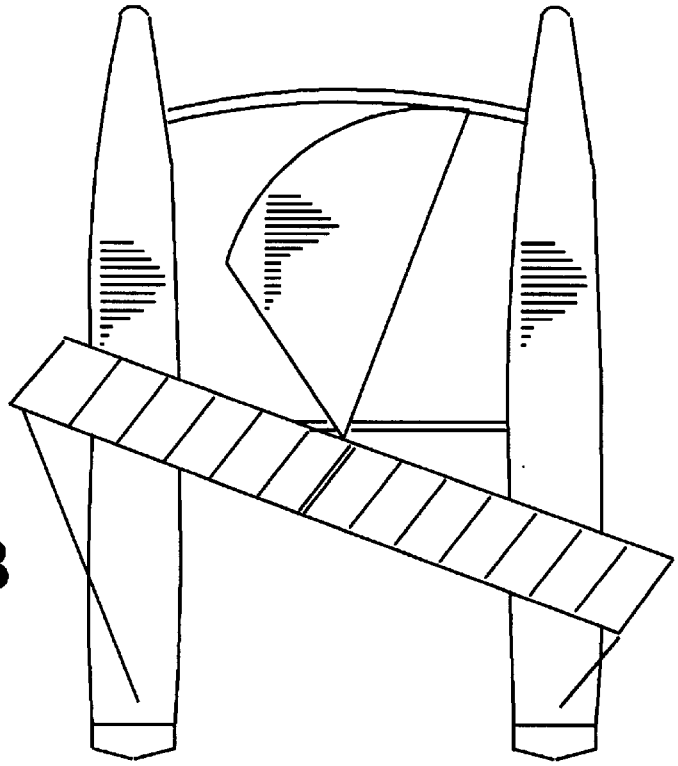

FIG. 6 shows a possible orientation of the mainsail and jib sail in run (run is a situation where the wind is aft of the boat). The mainsail can be tilted along three degrees of freedom to achieve maximum lift and thrust. The forefoot of the jib sail tracks the athartship tilt of the mainsail, and can be trimmed for the exact heading with respect to the wind and wind and sea conditions. Of course, the system will be adjusted to different angles and trim depending on the exact wind direction (directly astern as opposed to an angle off the beam).

Figure 7A:
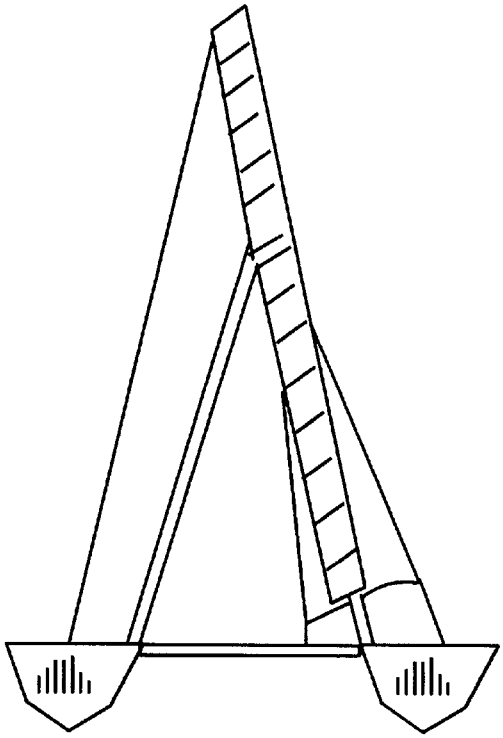
FIG. 7 shows how the present invention is operated in run (wind aft).
Figure 7B:
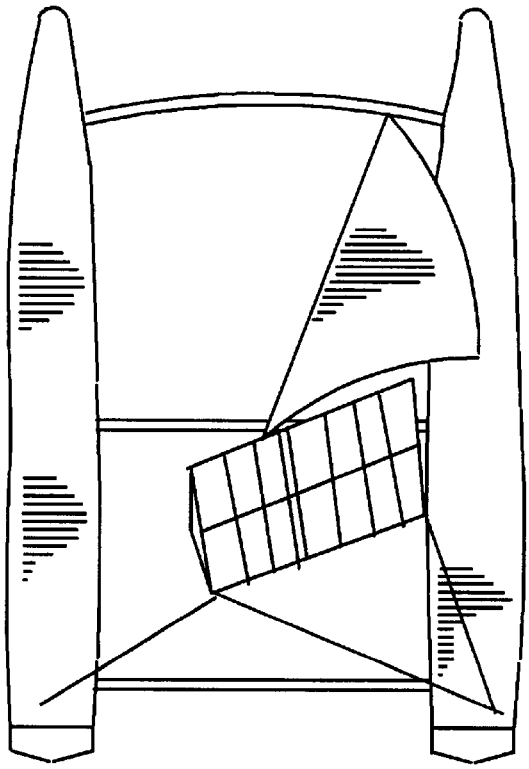

FIG. 7 shows a possible orientation of the mainsail and jib sail in reach or tack (reach is when the wind is athartships, while tack is when the wind is at an angle off the bow—tacking is the art of taking a sailboat into the wind by alternately changing heading with respect to the wind from port bow to starboard bow, etc.). Again, the system will be adjusted to different angles depending on the exact wind direction and on conditions. The angle will be changed on each tack if an attempt is being made to keep an average heading into the wind.

Sailing a boat using the present invention consists of adjusting the yaw of the mainsail and jib sail, and then adjusting the amount of sail trim in each sail. The degree of yaw of the mainsail (which can control the amount of yaw of the jib sail) can be controlled by adjusting the position of the forefoot of the mainsail. This can be connected to its track by a traveler and fixed with lines an cleats. The top of the mainsail can be simultaneously braced by adjusting lines attached to the head of the longitudinal spar. Sail trim of the mainsail can be adjusted by lines attached to the aft of the mainsail at the center, and bottom cross spars and secured by cleats. Sail trim of the jib can be adjusted by lines attached to the aft foot of the jib and fastened to the traveler at the fore foot of the mainsail. To reduce the amount of wind in each sail, one can loosen the line affecting sail trim (spill the wind), or turn the boat into the wind (luff the sails).

It is to be understood that the above-described arrangements are merely illustrative of the application of the principles of the invention, and that other arrangements may be devised by those skilled in the art without departing from the spirit and scope of the invention.

I claim:

1. A lift-creating sail system comprising, in combination:

a boat with at least one hull;

a substantially rectangular mainsail supported at its middle from an A-frame attached to said hull, said mainsail free to move independently along each of three axes;

a substantially triangular jib sail having an active area with a first, second, and third corner, the first corner of said jib sail constrained to move along a curved track, said track attached to said hull forward of said A-frame, the second corner of said jib sail attached to said A-frame;

adjustment of said sails to achieve maximum lift and thrust and minimum drag in any wind condition by tilting said mainsail athartships;

tilting said mainsail fore or aft; yawing said mainsail and said jib sail independently to achieve optimum performance of said boat.

2. The lift-creating sail system claimed in claim 1 further comprising a means for changing active wind area of said mainsail to control said lift and said drag.

3. The lift-creating sail system claimed in claim 1 whereby said mainsail contains a plurality of panels attached to a set of spars, each of said panels having an active area.

4. The lift-creating sail system claimed in claim 3 further comprising a furling system whereby the active area of each of said panels can be varied.

5. The lift-creating sail system claimed in claim 3 whereby the active area of said jib sail can be varied by furling.

6. The lift-creating sail system claimed in claim 1 whereby said jib sail is coupled to said mainsail so that yaw of said jib sail is similar to yaw of said mainsail.

7. The lift-creating sail system claimed in claim 3 further comprising an air-gap between fore and aft panels of said mainsail for airflow optimization.

8. A sail system for monohull or multi-hull sailboat that creates lift as well as thrust and drag, the sail system comprising, in combination, a substantially rectangular mainsail with a midpoint, and a substantially triangular jib sail with a top corner; the mainsail made of a plurality of panels with an air-gap located between fore and aft panels to optimize airflow across the mainsail, the mainsail attached near said midpoint to an A-frame which itself is firmly attached to the boat; the mainsail attached in a manner that allows it to pivot with three degrees of freedom being able to be set to create optimum lift and thrust for any wind; the jib sail mounted forward of the mainsail, its top corner attached to the A-frame where the mainsail is attached, the jib sail also creating lift and thrust, the jib sail and the mainsail both being ajustably free to assume any yaw angle with respect to the boat, the mainsail also being free to tilt fore and aft to any angle with respect to the boat, the sail system being trimmed to capture a desired amount of wind creating optimum lift and thrust for wind and sea conditions and desired boat speed.

9. The sail system claimed in claim 8 further comprising a set of longitudinal and cross spars holding the panels of the mainsail in place.

10. The sail system claimed in claim 9 whereby there are two panels in the mainsail.

11. The sail system claimed in claim 9 whereby each panel's area in the mainsail can be varied with a furling system attached to the longitudinal spars.

* * * * *